US008636185B2

(12) United States Patent
Largo et al.

(10) Patent No.: US 8,636,185 B2
(45) **Date of Patent: *Jan. 28, 2014**

(54) FASTENER ADVANCE DELAY FOR FASTENER DRIVING TOOL

(75) Inventors: Marc Largo, Gurnee, IL (US); Hanxin Zhao, Northbrook, IL (US); Christopher H. Porth, Gurnee, IL (US); Daniel Birk, McHenry, IL (US)

(73) Assignee: Illinois Tool Works Inc., Glenview, IL (US)

( * ) Notice: Subject to any disclaimer, the term of this patent is extended or adjusted under 35 U.S.C. 154(b) by 453 days.

This patent is subject to a terminal disclaimer.

(21) Appl. No.: 12/946,292

(22) Filed: Nov. 15, 2010

(65) Prior Publication Data

US 2012/0118932 A1 May 17, 2012

(51) Int. Cl.
*B25C 1/08* (2006.01)

(52) U.S. Cl.
USPC ..... 227/2; 227/109; 227/130; 227/136

(58) Field of Classification Search
USPC ..... 227/2, 130, 109, 136
See application file for complete search history.

(56) References Cited

U.S. PATENT DOCUMENTS

| | | | | |
|---|---|---|---|---|
| 2,572,012 | A * | 10/1951 | Curtis | 227/137 |
| 2,993,208 | A * | 7/1961 | Cast et al. | 227/112 |
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 5,197,646 | A | 3/1993 | Nikolich | |
| 5,263,439 | A | 11/1993 | Doherty et al. | |
| 6,145,724 | A | 11/2000 | Shkolnikov et al. | |
| 2006/0186171 | A1 * | 8/2006 | Porth et al. | 227/136 |
| 2008/0314953 | A1 | 12/2008 | Moeller et al. | |
| 2010/0176175 | A1 | 7/2010 | Tamura et al. | |
| 2010/0258608 | A1 | 10/2010 | Porth | |

* cited by examiner

*Primary Examiner* — Michelle Lopez
(74) *Attorney, Agent, or Firm* — Greer, Burns & Crain, Ltd.; Patty Chidiac; Mark W. Croll

(57) ABSTRACT

A nailer includes a power source including a piston reciprocating within a cylinder, a driver blade secured to the piston for common movement relative to a nosepiece, a magazine connected to the nosepiece for feeding fasteners sequentially for being driven into a workpiece by the driver blade, a delay mechanism operatively associated with the magazine and configured for engaging a second fastener and delaying advancement of the subsequent fastener to the nosepiece until the driver blade returns to the pre-firing position after driving a leading fastener.

7 Claims, 5 Drawing Sheets

FASTENER ADVANCE DELAY FOR FASTENER DRIVING TOOL

BACKGROUND

The present invention relates generally to handheld power tools, and specifically to fastener driving tools, including, but not limited to combustion-powered fastener-driving tools, also referred to as combustion tools or combustion nailers, as well as pneumatic nailers and electric nailers employing reciprocating driver blades and magazine feeders.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439; 6,145,724 and 7,341,171, all of which are incorporated by reference herein. Similar combustion-powered nail and staple driving tools are available commercially from ITW-Paslodeu of Vernon Hills, Ill. under the IMPULSE®, BUILDEX® and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. The engine includes a reciprocating piston with an elongated, rigid driver blade disposed within a single cylinder body. Fasteners are fed magazine-style into the nosepiece, where they are held in a properly positioned orientation for receiving the impact of the driver blade.

When the user depresses the tool against a workpiece, the tool closes the combustion chamber and fuel is delivered into the combustion chamber, after fuel/air mixing, the user activates the trigger, initiating a spark with the ignition spark unit, then the burnt gas generates a high pressure to push the piston down and drive the nail. Just prior to the piston impacting the bumper, the piston passes through the exhaust port, and some of the gas is exhaust. The combustion chamber generates vacuum pressure to retract the piston back to the pre-firing position. Simultaneously, the fastener feeding mechanism feeds the next fastener into a pre-driving position in the nosepiece or nose (the terms are considered interchangeable). However, due to friction caused by the feeding mechanism urging fasteners against the driver blade, the return of the piston is slowed or even stopped.

More specifically, once the nail driving process is complete, a subsequent timing relationship between the return of the drive piston and advancement of the feeder mechanism is also important to obtain reliable piston return and nail feeding. The preferred timing scenario is for the drive piston to return to the pre-firing position before the feeder mechanism advances the nail into the tool nosepiece. In conventional nailers, the feeder mechanism attempts to advance the nail into the nose while the drive piston and driver blade is returning to the pre-firing position. This results in the nail being biased against the driver blade during the return cycle. Only when the driver blade is fully retracted to its pre-firing position and a clear fastener passageway is provided does the fastener reach its drive position.

SUMMARY

The above-listed drawbacks of conventional nailers are met or exceeded by the present tool, featuring a mechanism for delaying the fastener advance of the second and subsequent fasteners until after the piston has returned to the pre-firing position after driving a leading fastener. The present fastener delay can be accomplished mechanically or electromechanically. When operated mechanically, the fastener delay mechanism is activated directly by the position of the driving element, such as a driver blade. When operated electromechanically, the fastener delay mechanism is energized or actuated for a specified period of time or until the position of the piston or driver blade activates a position switch. After prolonged use, when combustion-powered, the tool commonly heats up, which slows piston return even more than when the tool is first used. An advantage of the present fastener delay mechanism is that the fastener is delayed a sufficient period of time regardless of tool temperature.

Another advantage of the present fastener delay mechanism occurs when applied to tools requiring a strong biasing force for fastener advancement, typically using a feed pawl or claw member to feed the fastener, which causes significant friction force between the fastener and the driver blade. Such fastener drive systems are disclosed in commonly-assigned U.S. patent application Ser. No. 11/820,942, published as US Patent Application Publication No. 2008-0314953-A1, incorporated by reference herein. The present system reduces the friction applied to the driver blade, facilitating a rapid return to the pre-firing position.

More specifically, a nailer includes a power source including a piston reciprocating within a cylinder, a driver blade secured to the piston for common movement relative to a nosepiece, a magazine connected to the nosepiece for feeding fasteners sequentially for being driven into a workpiece by the driver blade, a fastener delay mechanism operatively associated with the magazine and configured for engaging a subsequent fastener and delaying advancement of the subsequent fastener or fasteners to the nosepiece until the driver blade returns to the pre-firing position after driving a leading fastener.

DETAILED DESCRIPTION

Figure 1:
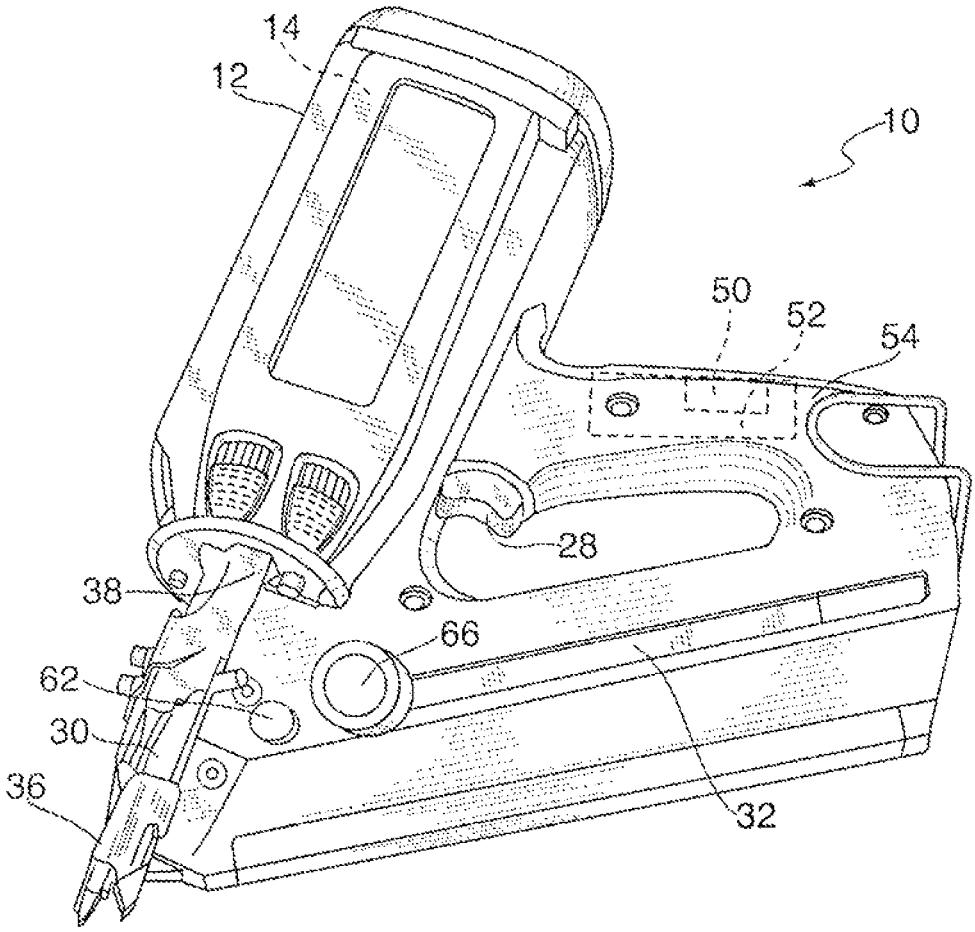
FIG. 1 is a top perspective view of a combustion nailer suitable for use with the present delay mechanism.
Figure 2:
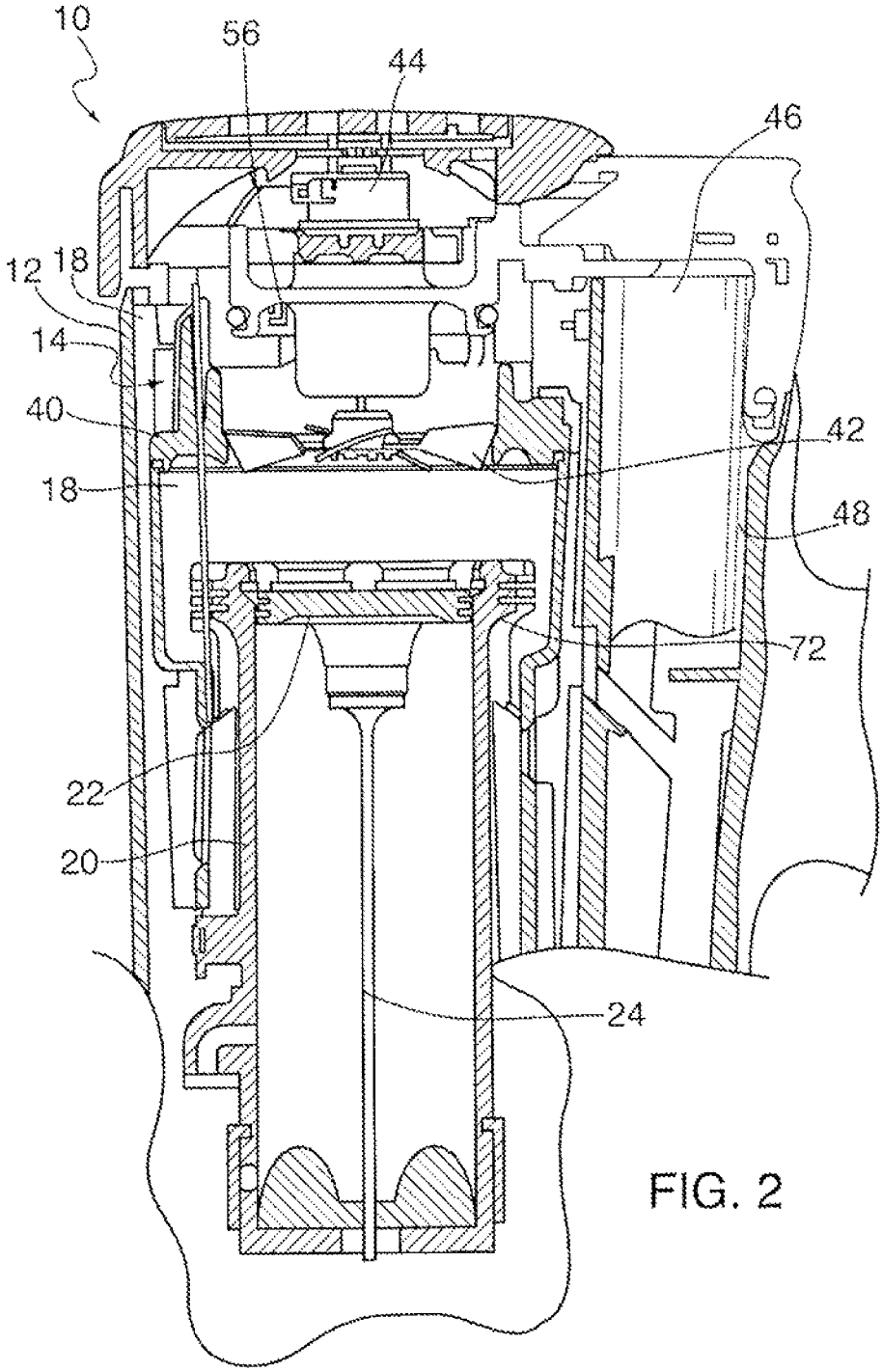
FIG. 2 is a fragmentary vertical section of the combustion nailer of FIG. 1.

Referring now to FIGS. 1 and 2, a fastener-driving tool of the type suitable with the present feeder mechanism is generally designated 10 and is depicted as a combustion-powered tool. The general principles of operation of such tools are known in the art and are described in U.S. Pat. Nos. 5,197,646; 4,522,162; 4,483,473; 4,483,474 and 4,403,722, all of which are incorporated by reference. However, it is contemplated that the present fastener delay mechanism is applicable to fastener driving tools powered by other power sources that employ a reciprocating driving element such as a driver blade for driving magazine-fed fasteners into a workpiece, including but not limited to electrically, pneumatically or powder driven nailers. Also, while it should be understood that the tool 10 is operable in a variety of orientations, directional terms such as "upper" and "lower" refer to the tool in the orientation depicted in FIG. 2.

A housing 12 of the tool 10 encloses a self-contained internal power source 14 within a housing main chamber 16. As in conventional combustion tools, the power source 14 is powered by internal combustion and includes a combustion chamber 18 (FIG. 2) that communicates with a drive cylinder 20. A drive piston 22 reciprocally disposed within the drive cylinder 20 is connected to the upper end of a driving element such as a driver blade 24. As is well known in the art, the piston 22 is connected to and moves with the driver blade 24. As such, in the present application, discussion of the position of the piston 22 will be understood to include the driver blade 24 and vice versa. An upper limit of the reciprocal travel of the drive piston 22 is referred to as a pre-firing position, which occurs just prior to firing, or the ignition of the combustion gases that initiates the downward driving of the driver blade 24 to impact a fastener 26 (FIG. 3) to drive it into a workpiece.

Through depression of a trigger 28, an operator induces ignition and a resulting combustion within the combustion chamber 18, causing the driver blade 24 to be forcefully driven downward through a nose or nosepiece 30. The nosepiece 30 guides the driver blade 24 to strike a first or forwardmost fastener 26*a* (FIG. 3) that had been delivered into the nosepiece via a fastener magazine 32. While a variety of magazines are contemplated as are known in the art, including strip and rotary types, in the present tool 10 the magazine 32 is preferably a linear or strip magazine in which the fasteners 26 are secured in a strip 34 using collating materials, typically metal, paper or plastic.

In proximity to the nosepiece 30 is a workpiece contact element 36, which is connected, through a linkage or upper probe 38 to a reciprocating valve sleeve 40, which partially defines the combustion chamber 18. Depression of the tool housing 12 towards the workpiece (not shown) in a downward direction in relation to the depiction in FIG. 2, causes the workpiece contact element 36 to move from a rest position to a firing position, closing the combustion chamber 18 and preparing it for combustion. Other pre-firing functions, such as the energization of a fan 42 in the combustion chamber 18 powered by a fan motor 44, and/or the delivery of a dose of fuel from a fuel cell 46 located in a fuel cell chamber 48 in the housing 12 to the combustion chamber 18 are performed mechanically or under the control of a control circuit or program 50 embodied in a central processing unit or control module 52 (shown hidden), typically housed in a handle portion 54 (FIG. 1) of the housing 12.

Upon a pulling of the trigger 28, a spark plug 56 is energized, igniting the fuel and gas mixture in the combustion chamber 18 and sending the drive piston 22 and the driver blade 24 downward toward the waiting leading fastener 26*a* for entry into the workpiece. While in the present application the leading fastener 26*a* is first in line and is the next fastener to be driven, it is contemplated that other selected fasteners could be designated the leading fastener depending on the configuration of the tool 10. The subsequent bottoming out of the piston 22 and return, and the exhaust, clearing and other functions of the tool 10 are well known in the art and discussed in the patents incorporated by reference, and need not be addressed here.

Figure 3:
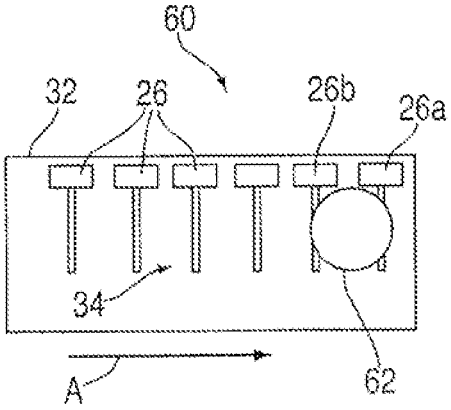
FIG. 3 is a schematic front elevation of a magazine equipped with the present fastener delay mechanism.
Figure 4:
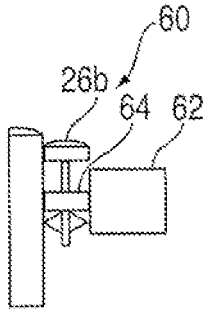
FIG. 4 is a side elevation of the embodiment of FIG. 3.

Referring now to FIGS. 3 and 4, a main feature of the present tool 10 is a fastener delay system or mechanism, generally designated 60. An electro-magnetic solenoid 62 including a reciprocating plunger 64 is mounted to the tool 10, such as to the magazine 32, to be at an angle and preferably perpendicular to the strip 34 of fasteners 26. It is contemplated that the angle of orientation of the solenoid 62 relative to the fasteners 26 may vary to suit the situation. Also, while the mounting position of the solenoid 62 on the tool 10 may vary to suit the situation, in the preferred embodiment, the solenoid is mounted to engage the strip 34 between the leading and a subsequent fastener, respectively designated 26*a*, 26*b*. It is not required that the solenoid 62 be located between the leading and subsequent fasteners in the magazine, or those located closest to the nosepiece 30. As is known in the art, the magazine 32 is provided with a magazine follower 66 (FIG. 1) which urges the strip 34 in the direction of the arrow A towards the nosepiece 30.

The solenoid 62 is electrically connected to, and controlled by, the control program 50 as is known in the art. The plunger 64 reciprocates between a retracted position and an extended position (FIG. 4). In this application, it will be understood that "retracted" and "extended" refer to the position of the plunger 64 as it is disposed for respectively allowing the passage of, or blocking the passage of fasteners 26 towards the nosepiece 30. Various mechanical assemblies are contemplated for achieving these functions. In the retracted position, the fasteners 26 are free to move toward the nosepiece 30 through urging of the biased follower 66, as in standard nailer operation. In the extended position, the first fastener 26*a* may be driven by the driver blade 24, but the second fastener 26*b* and the remainder of the strip 34 is prevented from movement towards the nosepiece 30. The control program 50 is configured so that the solenoid 62 is energized or activated to move the plunger 64 to the extended position for a specified period of time. While the duration of the period may vary to suit the circumstances, it is preferred that the solenoid be energized for approximately 100 milliseconds (msec), considered sufficient time for the piston 22 to return to the pre-firing position (FIG. 2).

Figure 5:
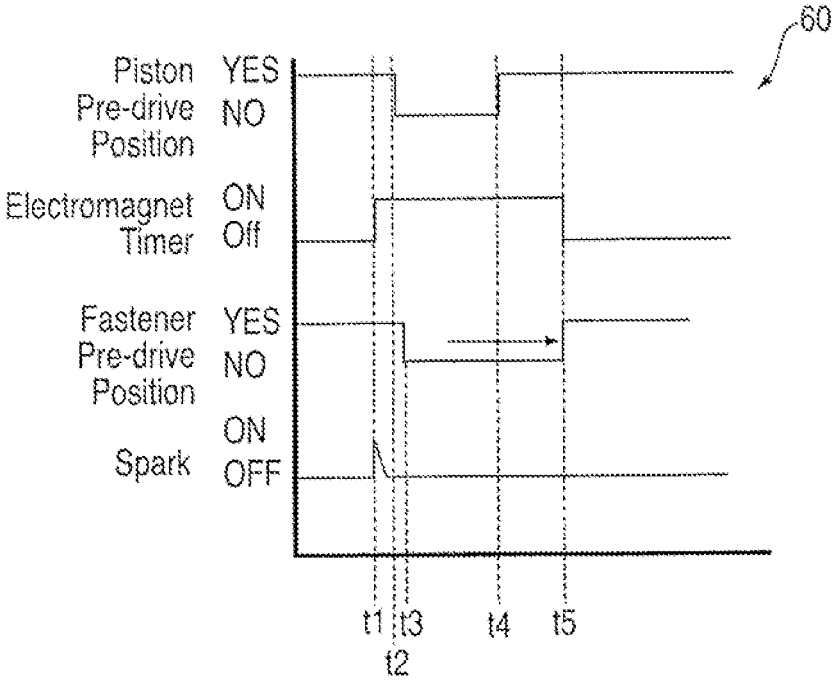
FIG. 5 is a timing chart of the present fastener delay mechanism.
Figure 6:
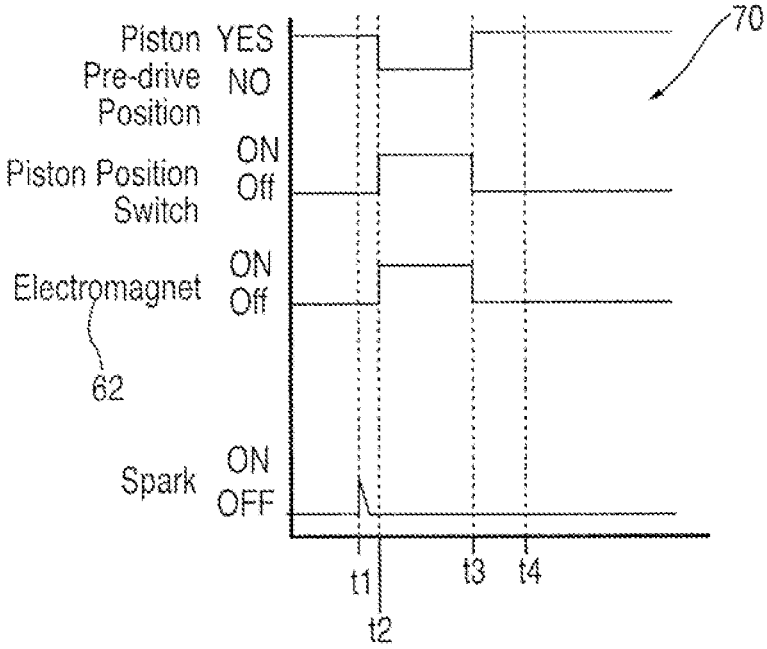
FIG. 6 is a timing chart of the operation of the electromagnetic solenoid.

Two control mechanisms can be used on the control of the solenoid 62: a timing delay control system as shown in FIG. 5, and a piston position signal control as described in FIG. 6.

Referring now to FIG. 5, a timing chart is schematically shown indicating the cooperation of the control program 50 and the present fastener delay mechanism 60. At time t1, a spark is initiated at the spark plug 56 by the user pulling the trigger 28 as is known in the art. There is a small program delay between pulling the trigger 28 and the actual initial spark generation, as is known in the art. Simultaneously with the spark generation, the control program 50 initiates an electromagnetic timer function 68 which is a clock set for a preset period, preferably approximately 100 msec, which may vary to suit the situation. The timer 68 indicates the energization of the solenoid plunger 64 into the extended position.

Due to the initial delay, the combustion does not occur until t2, when the piston 22 begins traveling down the cylinder 20, and the driver blade 24 impacts the first fastener 26*a*. The fastener pre-drive position on the timing chart reflects the position of the next to be driven fastener 26*b*. At t3, the first fastener 26*a* is driven by the descending driver blade 24. After that, there is no fastener in the pre-drive position until after t5, which designates the return of the piston 22 to the pre-firing position. Only at t5 does the timer 68 expire and the fastener 26*b* is again urged toward the nosepiece 30 due to retraction of the plunger 64. Thus, there is no frictional loading against the driver blade 24 by fasteners 26 as the piston 22 returns to the pre-firing position.

Referring now to FIG. 6, an alternate control system is generally designated 70. Components shared with the system 60 of FIG. 5 are designated with identical reference numbers. The main distinguishing feature of the system 70 compared to the system 60 is that instead of using a control system-controlled solenoid delay, the plunger 64 is operated by a piston position sensor 72 located near the upper end of the drive cylinder 20 at the piston pre-firing position (shown schematically in FIG. 2). The sensor 72 is contemplated as being an opto switch, a magnetic position sensor, or the like. At t1, a spark is initiated by the spark plug 56, sending the piston 22 down the cylinder at t2. This movement of the piston 22 from the pre-firing position activates or energizes the position sensor 72 as seen in FIG. 6. Also at t2, the sensor 72 then simultaneously activates the solenoid 62 to energize the plunger 64 and prevent fastener 26*b* and those behind it from advancing toward the nosepiece 30. Since there is less friction acting on the piston 22 and the driver blade 24, the piston returns relatively rapidly to the pre-firing position. Once the piston 22 returns to the pre-firing position at t3, the sensor 72 is deactivated or turned off, and the plunger 64 is immediately retracted, allowing the fasteners 26 to again move toward the nosepiece 30.

Figure 7:
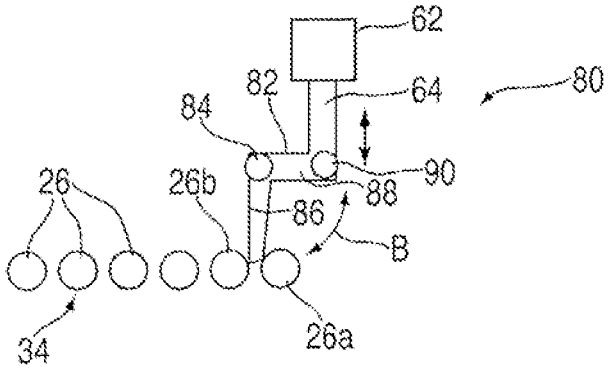
FIG. 7 is a schematic top view of an alternate embodiment of the present fastener delay mechanism employing a solenoid-operated pivoting cam.

Referring now to FIG. 7, yet another alternate embodiment of the present fastener delay mechanism is generally designated 80 and schematically represented. Components shared with the systems 60 and 70 are designated with identical reference numbers. A main difference between the system 80 and that of the systems 60 and 70 is that the plunger 64 does not directly act upon or engage the fasteners 26. Instead, the plunger activates an interim pivoting cam member 82, which pivots about an axis 84 transverse to the direction of movement of the fasteners 26. A first cam arm 86 extends from the pivot point and engages the fastener 26*b* when the solenoid 62 is energized. A second cam arm 88, preferably projecting at a right angle to the first cam arm 86, is pivotally connected to the plunger 64 by a pin 90 disposed parallel to the pivot axis 84. Thus, retraction of the plunger 64 due to deenergization of the solenoid 62 will pivot the first cam arm 86 counter-clockwise in an arc B as seen in FIG. 7 and away from the fasteners 26. It is contemplated that the system 80 may be operated by either of the control systems 60 or 70 described above.

Figure 8:
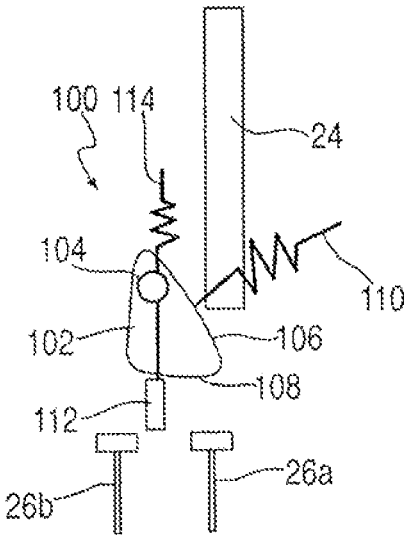
FIG. 8 is a schematic front view of a second alternate embodiment of the present fastener delay mechanism employing a mechanical system shown in a piston pre-firing position.
Figure 9:
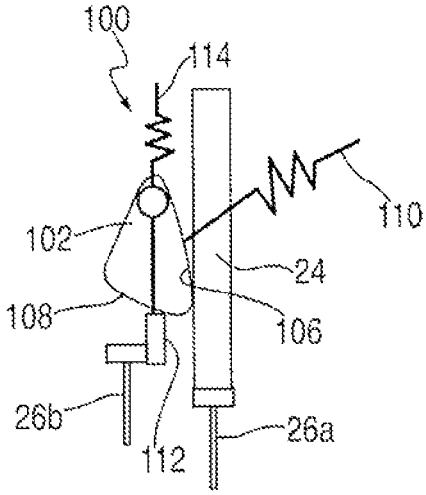
FIG. 9 is a schematic front view of the embodiment of FIG. 8 shown in a piston end of travel position with the fastener advance delayed.

Referring now to FIGS. 8 and 9, still another alternate embodiment is generally designated 100 and is referred to as a system or mechanism. Components shared with the embodiments 60, 70 and 80 are designated with identical reference numbers. A main distinction of the system 100 compared to the other embodiments is that the delay mechanism is operated solely mechanically by direct contact with the driver blade 24, such that, after ignition, the driver blade moving toward the fasteners 26 activates the delay system 100, which remains activated until the driver blade is retracted to the pre-firing position. As such, there is no electronic or electromechanical control over the system 100.

More specifically, the system 100 includes a generally wedge-shaped or lobed cam 102 connected to the tool 10 and pivoting about a transverse pivot axis 104 parallel to the axis 84 described in relation to FIG. 7. Also, the pivot axis 104 is disposed in an offset location on the cam 102. The cam 102 includes a first surface 106 and a second surface 108. As can be seen in FIGS. 8 and 9, the first and second surfaces 106, 108 form a common angle. A biasing element 110 such as a spring is connected to the first surface 106 to bias it towards the driver blade 24. Thus, the cam 102 is biased into a path of the driver blade 24, and the first surface 106 engages the driver blade.

The second surface 108 is in contact with a biased feed pawl 112 which reciprocates between a retracted position in which it does not engage the fasteners 26 (FIG. 8), and an extended position in which it engages the fastener 26*b* (FIG. 9). The feed pawl 112 is connected to the tool 10 using a variety of connection technologies, for example, as being pivotable about an axis (not shown) parallel to the direction of movement of the fastener strip 34. A biasing element 114 such as a spring is connected to the pawl 112 to bias it away from the fastener strip 34, or to the retracted position of FIG. 8.

Referring now to FIG. 9, as the driver blade 24 progresses toward the fastener 26*a*, the driver blade engages the first surface 106 and overcomes the biasing effect of the biasing element 110, causing the cam 102 to rotate about the axis 104 in the clockwise direction as shown. This rotation of the cam 102 causes the second surface 108 to engage the feed pawl 112 and to overcome the biasing force of the biasing element 114 so that the feed pawl moves to the extended position in which it blocks the fastener 26*b*, prevents further fastener advancement until the pawl is released, and reduces loading on the reciprocating driver blade 24, permitting more rapid return of the piston 22. The feed pawl 112 is released only when the driver blade 24 is sufficiently retracted to clear the first cam surface 106, which also occurs when the piston 22 reaches the pre-firing position.

While particular embodiments of the present fastener advance delay for a fastener driving tool have been described herein, it will be appreciated by those skilled in the art that changes and modifications may be made thereto without departing from the invention in its broader aspects and as set forth in the following claims.

The invention claimed is:

1. A nailer, comprising:

a power source;

a driving element in communication with said power source for creating reciprocal movement of said driving element relative to a nosepiece;

a magazine connected to said nosepiece for feeding fasteners sequentially for being driven into a workpiece by said driving element; and a fastener delay mechanism operatively associated with said magazine and configured for engaging a subsequent fastener and delaying advancement of the subsequent fastener to said nosepiece until said driving element returns to a pre-firing position after driving a first fastener;

said nailer includes a control program, and said delay mechanism is constructed and arranged to be controlled by said control program to energize said delay mechanism for a predetermined period of time; and said delay mechanism including a reciprocating plunger mounted transverse to a direction of movement of the fasteners in said magazine, being arranged for engaging a strip of fasteners between fasteners of the strip, and when energized, blocks movement of the fastener toward said nosepiece under control of said control program.

2. The nailer of claim 1 wherein said delay mechanism is an electromagnetic solenoid connected to said control program and having said reciprocating plunger which, when said solenoid is energized, blocks movement of the fastener toward said nosepiece for a predetermined period of time.

3. The nailer of claim 2 wherein said predetermined time is on the order of 100 msec.

4. The nailer of claim 1 wherein said driving element is a driver blade attached to a piston, and said nailer includes a piston position indicator switch, and said delay mechanism is an electromagnetic solenoid connected to said switch and being activated once said piston moves from said pre-firing position upon an ignition event, said solenoid having said reciprocating plunger which, when said solenoid is energized, blocks movement of the fastener toward said nosepiece until said piston position actuates said switch to indicate that the piston has reached said pre-firing position.

5. The nailer of claim 1 further including a control program connected to said delay mechanism and including a function for energizing said delay mechanism until a specified time corresponding to when said driving element reaches the pre-firing position.

6. The nailer of claim 1 wherein said delay mechanism is operated mechanically by direct contact with said driving element, such that, after ignition, the driving element moving toward the fasteners activates said delay mechanism, which remains activated until said driving element is retracted to said pre-firing position.

7. A nailer, comprising:

a power source;

a driving element in communication with said power source for creating reciprocal movement of said driving element relative to a nosepiece;

a magazine connected to said nosepiece for feeding fasteners sequentially for being driven into a workpiece by said driving element; and a fastener delay mechanism operatively associated with said magazine and configured for engaging a second fastener and delaying advancement of the second fastener to said nosepiece until said driving element returns to a pre-firing position after driving a first fastener, wherein said nailer includes a control program, and said delay mechanism is constructed and arranged to be controlled by said control program to be energized for a predetermined period of time, and said delay mechanism being triggered by the position of said driving element; and wherein said nailer includes a piston position indicator switch, and said delay mechanism includes an electromagnetic solenoid connected to said switch and being activated once said piston moves from said pre-firing position, said solenoid mounted for engaging a strip of fasteners between first two fasteners of the strip, and having a reciprocating plunger which, when said solenoid is energized, blocks movement of the fastener toward said nosepiece until said piston position actuates said switch to indicate that the piston has reached said pre-firing position.

* * * * *